United States Patent [19]

Tonegawa

[11] Patent Number: 4,643,559

[45] Date of Patent: Feb. 17, 1987

[54] ELECTROPHOTOGRAPHIC COPYING METHOD

[75] Inventor: Tadashi Tonegawa, Nara, Japan

[73] Assignee: Sharp Kabushiki Kaisha, Osaka, Japan

[21] Appl. No.: 737,069

[22] Filed: May 23, 1985

[30] Foreign Application Priority Data

May 23, 1984 [JP] Japan ..... 59-105086
May 23, 1984 [JP] Japan ..... 59-105088

[51] Int. Cl.[4] ..... G03G 15/00
[52] U.S. Cl. ..... 355/3 R
[58] Field of Search ..... 355/3 R, 3 TR, 3 TE, 355/47–51, 5, 11; 346/153.1

[56] References Cited

U.S. PATENT DOCUMENTS 4,352,549 10/1982 Ozawa ..... 355/3 R
4,380,383 4/1983 Daintrey et al. ..... 355/3 R

*Primary Examiner*—A. T. Grimley
*Assistant Examiner*—J. Pendegrass
*Attorney, Agent, or Firm*—Birch, Stewart, Kolasch & Birch

[57] ABSTRACT

There is disclosed an electrophotographic copying method applicable to an electrophotographic copying machine providing a photo-sensitive drum (hereinafter referred to as a first drum) and a drum capable of being brought into contact with or being separated from the first drum on the surface of which an insulation film is formed (hereinafter referred to as a second drum).

According to the present method, a latent image formed on the first drum is developed and, thereafter, the toner image transferred to the second drum first. The image transferred to the second drum is used to reproduce a second latent image on the first drum to obtain a copy therefrom.

4 Claims, 2 Drawing Figures

ELECTROPHOTOGRAPHIC COPYING METHOD

BACKGROUND OF THE INVENTION

The present invention relates to an electrophotographic coping process and more specifically to a method of reducing or enlarging an image by adjusting the positioning of a focusing lens assembly.

As is well known to those skilled in the art, the electrophotographic process is characterized by such basic steps as charging a photo-sensitive drum, exposing the drum to form a latent electrostatic image, developing the latent image with toner and transferring the developed image to a paper or the like.

In the conventional electrophotographic copy machine of small size or of medium size, there have been employed either one of two scanning methods for forming a latent image of an original on the photo-sensitive drum as follows:

(a) The platen holding an original is moved relative to the fixed optical-fiber-lens to scan the original, and the image of the original is exposed onto the drum via the optical-fiber-lens to form the latent image thereof, and (b) The mirror system is moved relative to the fixed platen to scan the original, and the image of the original is exposed onto the drum after passing through the focusing lens to form the latent image thereof.

In the copy machine of the type mentioned above, mechanical vibrations are caused due to the movement of the platen or the mirror system, especially when the direction of the movement is reversed. These vibrations are not too magnified when the copying speed is low.

However, in a copy machine having a higher copying speed, it becomes difficult to absorb such vibrations with the body of the machine and, therefore, blurring of the image is realized due to the vibrations.

SUMMARY OF THE INVENTION

One of the objects of the present invention is to provide a copying method capable of producing many copies in succession at a high copying speed without accompanying mechanical vibrations. The copying method according to the present invention is available especially for the copy machine of a small or medium size in which the platen or the mirror system is moved back and forth relative to the other.

A further object of the present invention is to provide a copying method capable of forming latent images of a set of originals in succession and repeatedly on one photo-sensitive drum after all of the set of originals have been once scanned directly. In other words, according to the present invention, it becomes possible to obtain a desired number of copies after all of the set of originals have been exposed once in succession.

Therefore, in the copy machine according to the present invention, it becomes unnecessary to repeat scanning of the original at every copying cycle.

An electrophotographic copying method according to the present invention is applicable to an electrophotographic copy machine providing a photo-sensitive drum (hereinafter referred to as the first drum) and a drum being capable of being brought into contact with or to part or be separated from the first drum on which an insulation film is formed (hereinafter referred to as the second drum).

The copying method according to the present invention is comprised of the following steps (a) to (i):

(a) exposing a first drum through a focusing lens assembly to form a first latent image of an original on the first drum, (b) developing the first latent image with toner, (c) transferring the image developed on the first drum to the second drum covered with an insulation film by making the second drum contact the first drum, (d) a step for parting the second drum from the first drum, (e) exposing the first drum to form a second latent image of the image transferred to the second drum from the first drum, (f) developing the second latent image with toner, (g) transferring the toner image developed on the first drum to a paper by bringing the paper into contact with the first drum, (h) fixing the image transferred to the paper, and (i) removing the toner and latent image from the second drum.

According to the present invention, after the optical system or platen has been moved back and forth once to expose the photo-sensitive drum (the first drum), the latent image can be reproduced on the first drum repeatedly via the second drum without scanning the original. Therefore, a desired number of copies can be obtained at a high speed without blurring of the image due to mechanical vibrations caused by the scanning movement of the scanning system.

There is also provided a copying method according to the present invention being characterized by following the steps of (a) to (k):

(a) exposing the first drum to form a first latent image of an original on the first drum, (b) developing the first latent image with toner, (c) transferring the image developed on a first drum to the second drum covered with an insulation film by bringing the second drum into contact with the first drum, (d) forming a set of images corresponding to a set of originals on the second drum by repeating the steps (a) to (c), (e) separating the second drum from the first drum, (f) exposing the first drum to form a second latent image of one of the images having been transferred to the second drum by step (d), (g) developing the second latent image with toner, (h) transferring the toner image developed on the first drum to a paper by bringing the paper into contact with the first drum, (i) fixing the image transferred to the paper, (j) making at least one copy of the set of the originals by repeating the steps (f) to (h), and (k) removing the toner and latent images on the second drum.

According to the present copying method, it becomes possible to obtain a desired number of copies of a set of originals without repeating the scanning of the originals.

BRIEF DESCRIPTION OF THE DRAWINGS

The present invention will now described more in detail by way of examples and with reference to the accompanying drawings in which;

FIG. 1 and FIG. 2 are schematical sectional views respectively showing different stages of a copy machine for which the present invention is applicable, wherein FIG. 1 shows the first half stage of the machine and FIG. 2 shows the last half stage thereof.

DESCRIPTION OF THE PREFERRED EMBODIMENTS

Figure 1:
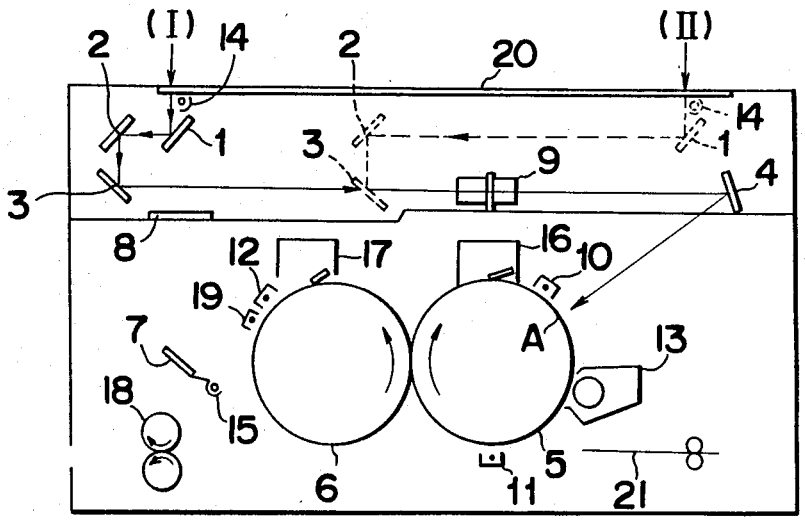

As is shown in FIG. 1, an optical scanning assembly for scanning optically an original to be copied is comprised of first, second and third mirrors 1, 2 and 3. The second and third mirrors 2 and 3 are driven to move at a velocity equal to one half of the velocity of the first mirror 1, as is well known to those skilled in the art.

The scanning assembly is stopped at a position indicated by an arrow (I) prior to the beginning of the scan. The state of the scanning assembly indicated by the dotted lines shows the state in which the scanning of the original of maximum length has been finished at the position indicated by an arrow (II). There are also provided an optical focusing lens assembly 9 and a fourth mirror 4 in the direction along which the image of the original reflected by the third mirror 3 proceeds. The light reflected by the fourth mirror 4 is projected at the position A onto a photo-sensitive drum 5 to expose the same. The photo-sensitive drum, namely the first drum 5, is so driven by a driving means (not shown) as to start to rotate clockwise in FIG. 1 at the beginning of one copying cycle.

Along the periphery of the first drum 5, a cleaner 16, a charger 10, a developer 13 and a transfer means 11 are arranged in a clockwise direction of FIG. 1 in the order of their citation. The cleaner 16 is provided for removing residual toner adhered to the first drum 5. The charger 10 is provided for charging the first drum 5 uniformly. The developer 13 is provided for developing the latent image formed on the first drum by applying toner thereto. The transfer means 11 is provided for transferring the toner image developed to a paper 21 being fed from the right side of FIG. 1.

The copy machine provides a second drum 6 being contactable with the first drum 5. On the peripheral surface of the second drum 6, a film made of an insulation material is formed. The second drum 6 can be driven to rotate clockwise or counterclockwise by a suitable drive means (not shown). The tangential rotation speed of the second drum 6 is set to equal that of the first drum 5 when both drums are in contact with each other and is set slower than that of the first drum 5 when the second drum 6 is set apart from the first drum 5.

Although the first and second drums 5 and 6 are depicted to have the same radius in FIG. 1, the second drum 6 may have a radius different from that of the first drum 5.

The second drum 6 can be manufactured according to either one of the following methods (1) to (3).

(1) A transparent insulation film is adhered to or bonded to the surface of a drum having been finished to a mirror surface.

Properties needed for the transparent insulation film are as follows:

(a) It has such a stiffness as not to be wrinkled during the step for removing residual toner, (b) It has excellent electro-statical properties, for instance, high durability against high voltage, and (c) The transparency of the film is kept during a long period of use of the drum.

Films made of synthetic resin, for instance, polyethylene-terephthalate or polypropylene can be used for the film having desirable properties just mentioned above. The thickness of the film is 30 to 100 micrometers and desirably 35 to 40 micrometers. The drum is desirably made of, for instance, aluminum or stainless-steel. It is easy to finish or polish the surface of a drum made of aluminum.

The film can be formed on the surface of the drum by depositing a polymer of monomer such as ethylene, propylene or methyl-methacrylete (polyethylene, polypropylene or polymethacrylete) thereon with use of so-called plasma-polymerization in a vacuum container or by depositing $SiO_2$ thereon by evolving gases, such as $SiH_4$ and, $O_2$ introduced in a vacuum container with plasma-discharge.

(2) A white insulation polymer-film is adhered to or bonded to the surface of a drum being smoothed not necessarily being finished, to a mirror plane.

Properties needed for the film are as follows:

(a) It has such a stiffness as not to be wrinkled during the step of removing residual toner, (b) It has a sufficient durability under a high voltage in order to prevent possible generation of pin-holes, and (c) The white color thereof is not faded out during a long period of use of the drum.

(3) A transparent insulation film is adhered to or bonded to the surface of the drum being colored in white after smoothing thereof.

In this method, the drum of mirror surface is replaced for the white colored drum. Therefore, the film should have all the properties mentioned in the method (1).

Around the second drum 6, manufactured according to either one of methods (1) to (3), a copy lamp 15, a discharger 19, a charger 12 and a cleaner 17 are arranged, respectively. The copy lamp 15 is provided for illuminating the surface of the second drum 6. The discharger 19 is provided for removing residual charge on the second drum. The charger 12 is provided for charging the surface of the second drum uniformly. The cleaner 17 is provided for removing residual toner from the surface of the second drum. Further, a heat-roller 18 is provided for fixing the image transferred onto the paper 21 by the transfer means 11.

It is to be noted that the copy machine according to the present invention provides another scanning system in order to scan the image transferred onto the film of the second drum.

Figure 2:
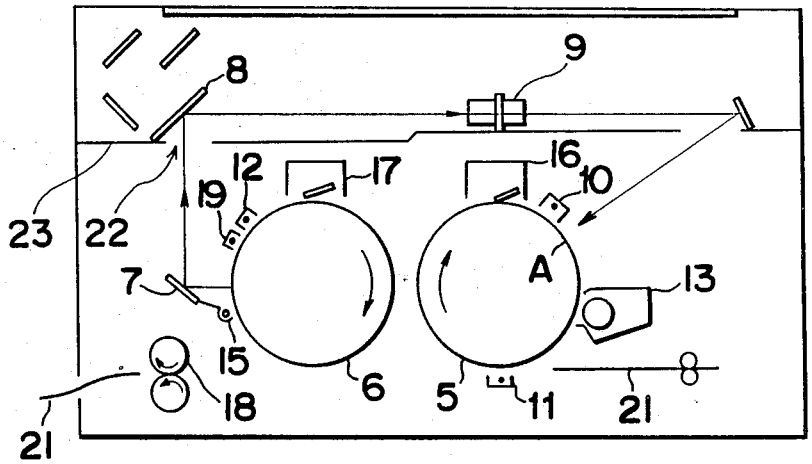

As is shown clearly in FIG. 2, the light reflected by the second drum 6 is reflected upwardly by a fifth mirror 7 first and is passed through an aperture 22 provided on a partition plate 23. The aperture 22 is closed by a sixth mirror 8 in the first half of a copy-cycle and is opened in the last half of the cycle. The sixth mirror 8 reflects the light passing through the aperture 22 in the direction of the optical axis of the focusing lens 9.

Hereinafter, the steps according to the present invention will be explained.

FIG. 1 shows the state of the copy machine in which the first half steps (a) to (d) of the copying cycle are to be accomplished.

(a) Forming The First Latent Image

This step is started when a copy-button (not shown) is pushed after an original is set on the platen 20.

The first drum 5 starts to rotate in the clockwise direction indicated by the arrow and is charged uniformly by the charger 10. AT the same time, the scanning mirror assembly is started to scan the original. The reflected light of the original is projected onto the first drum 5 by the fourth mirror 4 to form the first latent image of the original thereon.

(b) Developing step

In this step (b), the first latent image formed on the first drum 5 is developed with toner by the developer 13.

(c) Transferring step

In this step (c), the toner image developed is transferred to the second drum 6. As is shown in FIG. 1, the second drum 6 is kept in contact with the first drum 5 and is rotated in the counter clockwise direction. The charger 12 charges the surface of the second drum 6 uniformly with charge having a polarity opposite to that of the toner. During the rotation of the second drum 6 in contact with the first drum 5, the image developed on the first drum 5 is transferred to the second drum 6.

It is to be noted that the image transferred to the second drum 6 is a normal image since the image developed on the first drum 5 is a reversed image. Therefore, on the second drum 6, the image identical to the original is formed.

FIG. 2 shows the state of the copy machine in which the last steps (d) to (i) of the copying cycle are to be completed.

(d) Parting or Separating the Second Drum From The First Drum

First, and second drum 6 is moved apart from the first drum 5.

(e) Forming The Second Latent Image

In this step (e), the first drum 5 is driven to rotate in a clockwise direction and also the second drum 6 is driven to rotate in the clockwise direction. The copy lamp 15 is turned on and the sixth mirror 8 is rotated to the position indicated by the solid line in FIG. 2. Further, the first drum 5 is so charged by the charger 10 as to form a latent image thereon.

According to this step, the image formed on the second drum is relatively scanned and is projected at the position A onto the first drum 5 under the same conditions to those of the direct scan of the original steps (a) to (c). Namely, the second latent image is formed from the image having been formed on the second drum 6 not the image of the original itself.

It is to be noted that the tangential rotation speed of the second drum 6, which is controlled to have the same speed to that of the first drum 5, can be increased to a speed higher than that in the step (b).

(f) Developing the Second Latent Image

The second latent image formed on the first drum 5 is developed by the developer 13 as in the step (c).

(g) Transferring the Image

The image developed is transferred onto the paper 21 by the transfer station 11.

(h) Fixing the Image

The image transferred to the paper 21 is fixed by the heat-roller 18.

As is clearly understood from the above, a succession of multiple copies can be obtained by repeating steps (e) to (h).

Namely, according to the copying method of the present invention, copying cycles are repeated by driving the first and second drums without scanning the original itself after it has been done once. Therefore, mechanical vibrations caused during the copying cycle can be minimized to those accompanied by the rotations of the drums, since the optical system for scanning the original is not driven during the copying. Due to this, a higher copy speed can be realized.

(i) After all the steps necessary for obtaining a desired number of copies were completed, residual toner and charges on the second drum 6 are removed. The toner is removed by the cleaner 17 and charge removed by the discharger 19.

In the case that only one copy is needed, it can be obtained by transferring the developed image of the first latent image onto a paper directly as is usually done in the conventional copy machine.

A second embodiment of the present invention is characterized in that a desired number of copies of a set of originals can be obtained without scanning the step of originals if it has been done throughout the set of originals once.

The second copying method is comprised of the following steps:

(a) Forming a First Latent Image

This step (a) is essentially same to the step (a) of the first embodiment of the present invention.

The only difference is that the tangential rotation speed of the first drum 5 is set to (1/k)Vo; wherein k images is a positive integer larger than 1 and Vo is a scanning speed of the scanning optical system. Therefore, the first latent image formed on the first drum 5 is reduced to (1/k) in the peripheral direction thereof.

(b) Developing the First Latent Image

This step is essentially same to the step (b) of the first embodiment. Namely, the fist latent image is developed by the developer 13.

(c) Transferring the Image to the Second Drum

This step (c) is essentially same to the step (c) of the first embodiment. However, it is to be noted that the area of the second drum to which the image is transferred is limited to a portion of (1/k) of the total area.

(d) The steps (a) to (c) are repeated k times as to obtain the images of the set of originals on the second drum 6. In order words, k images are formed on the second drum in series, since each image is reduced to (1/k).

(e) Then, the second drum 6 is separated from the first drum 5.

(f) Forming the Second Latent Image

This step (f) is essentially the same as the step (e) of the first embodiment. However, it is to be noted that the tangential rotation speed of the first drum is set k times that of the second drum in this step (f). The second latent image formed on the first drum has the same size to that of the original since the image reduced to (1/k) is enlarged to k times.

(g) The step (g) is essentially the same to the step (f) of the first embodiment.

(h) Step (h) is also essentially the same to the step (g) of the first embodiment.

(i) Step (i) is essentially the same to the step (h) of the first embodiment.

(j) The steps (f) to (h) are repeated k times so as to obtain one copy of the originals. If a desirable number of copies are needed, steps (f) to (i) are repeated further.

It is to be noted that there is obtained each copy of a set of originals according to the second method of the present invention. In other words, each copy obtained has been sorted automatically.

(k) After completing the steps (a) to (j), toner and charge on the second drum are removed as stated in the step (i) of the first embodiment.

Though the image is first reduced to (1/k) and is enlarged to k times thereafter in the second embodiment mentioned above, magnification of the image is not limited to the above, as is apparently understood from the principle of the second method.

While there has been described the preferred embodiments, modifications and variations being obvious to those skilled in the art are possible without departing from the spirit of the invention. The scope is therefore to be determined solely by the appended claims.

What is claimed is:

1. An electrophotographic copying method applicable to an electrophotographic copy machine including a first photo-sensitive drum and a second drum capable of being brought into contact with or being separated from said first drum on the surface of which an insulation film is formed comprising the steps of:

(a) exposing said first drum through a focusing lens assembly to an original to form a first electrostatic latent image of said original on said first drum,
(b) developing said first latent image with toner,
(c) transferring said toner image developed on said first drum to said second drum by bringing said second drum into contact with said first drum,
(d) Separating said second drum from said first drum,
(e) exposing the toner image transferred to said second drum to said first drum through said focusing lens assembly to form a second latent image thereof on said first drum,
(f) developing said second latent image with toner,
(g) transferring the toner image developed on said first drum to a paper copy by bringing said paper into contact with said first drum,
(h) fixing said toner image transferred to said paper, and
(i) removing said toner and latent image from said second drum.

2. An electrophotographic copying method applicable to an electrophotographic copy machine including a first photo-sensitive drum and a second drum capable of being brought into contact with or being separated from said first drum on the surface of which an insulation film is formed comprising the steps of:

(a) exposing said first drum to an original to form a first electrostatic latent image of said original on said first drum,
(b) developing said first latent image with toner,
(c) transfering said toner image developed on said first drum to said second drum by bringing said second drum into contact with said first drum,
(d) forming a set of images corresponding to a set of originals on said second drum by repeating steps (a) to (c),
(e) separating said second drum from said first drum,
(f) exposing said first drum to form a second latent image of at least one of the images having been transferred to said second drum by step (d),
(g) developing said second latent image with toner,
(h) transferring said toner image developed on said first drum to a paper by bringing said paper into contact with said first drum,
(i) fixing the image transferred to said paper,
(j) making at least one copy of the set of originals by repeating the steps (f) to (h), and
(k) removing said toner and latent images on said second drum.

3. The method of claim 2, wherein in the step of forming said first latent image on said first drum, the tangential rotational speed of said first drum is set to (1/k) Vo, wherein:

k=number of images formed on the second drum

Vo=scanning speed of the scanning optical system steps (a) to (c) are repeated (k) times to obtain the images of the set of originals on said second drum, the tangential rotational speed of said first drum during the step of forming said second latent image is (k) times that of said second drum and steps (f) to (h) are repeated (k) times so as to obtain at least one copy of the originals.

4. The method of claim 3, wherein steps (f) to (i) are repeated at least one time.

* * * * *